United States Patent [19]

Faillon et al.

[11] 4,243,961

[45] Jan. 6, 1981

[54] APPARATUS FOR SELECTING THE RESONANCE FREQUENCY OF A MICROWAVE DEVICE COMPRISING A PLURALITY OF CAVITIES

[75] Inventors: Georges Faillon; Claude Carreyve, both of Paris, France

[73] Assignee: Thomson-CSF, Paris, France

[21] Appl. No.: 51,957

[22] Filed: Jun. 25, 1979

[30] Foreign Application Priority Data

Jun. 29, 1978 [FR] France ..... 78 19503

[51] Int. Cl.[3] ..... H01P 7/06

[52] U.S. Cl. ..... 333/233; 333/209

[58] Field of Search ..... 333/209, 232, 233; 315/5.47, 5.53; 334/7, 74, 77

[56] References Cited

U.S. PATENT DOCUMENTS

| | | | |
|---|---|---|---|
| 2,808,506 | 10/1957 | Skwarek | 334/77 X |
| 3,271,715 | 9/1966 | Berman et al. | 334/77 X |
| 3,617,799 | 11/1971 | Schmidt et al. | 315/5.47 |
| 3,838,308 | 9/1974 | Merdinian et al. | 315/5.47 |
| 4,144,511 | 3/1979 | Collings | 334/7 |

*Primary Examiner*—Paul L. Gensler

*Attorney, Agent, or Firm*—Roland Plottel

[57] ABSTRACT

A microwave apparatus comprising n aligned cavities 1 in each of which one of the walls is formed by a plunger 2 integral with a shaft 3. The n shafts 3 bear against n aligned stops 5. Several lines of n stops 5, against which the shafts 3 successively bear, are carried by a support 10 which in one illustrative embodiment comprises a cylinder of revolution the axis of rotation 00' of which is orthogonal to the shafts 3 of the plungers 2, the degree of penetration of each stop 5 with the support 10 being adjustable to adjust the resonance frequencies of the cavities.

10 Claims, 9 Drawing Figures

Figure 1A:
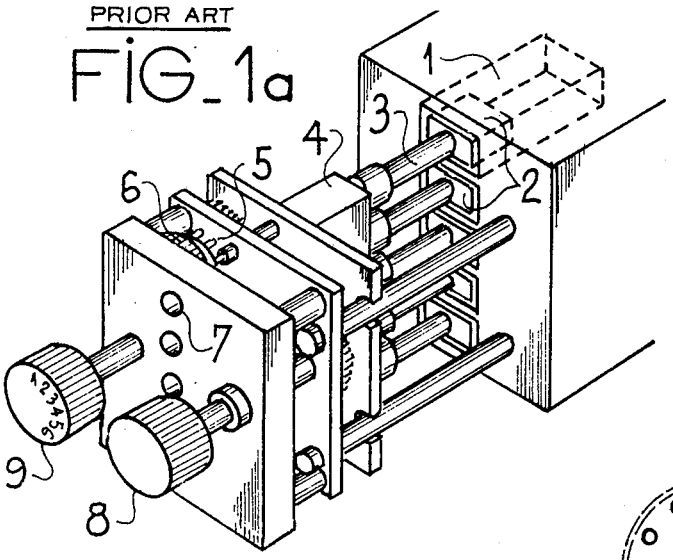
PRIOR ART FIG 1a

APPARATUS FOR SELECTING THE RESONANCE FREQUENCY OF A MICROWAVE DEVICE COMPRISING A PLURALITY OF CAVITIES

This invention relates to an apparatus for selecting the resonance frequency of a microwave device.

It is known that the resonance frequency of microwave cavities of the type used in particular in klystrons and frequency filters can be varied by modifying the volume of the cavities.

The devices for selecting the resonance frequency of the microwave cavities by modifying their volume enable the service frequency band of the klystron or filter using these cavities to be shifted. The frequency band covered by the klystron or the filter is thus considerably increased. This result is particularly interesting in the case of klystrons operating as amplifiers which are attended by the disadvantage of having a narrow momentary pass band, the momentary pass band being defined as the frequency band which extends around the central frequency $F_c$ and for which the attenuation is below a limiting value generally fixed at one or three decibels.

The narrow momentary pass band of these klystrons is troublesome, particularly in the telecommunication field where the user seeks to cover the entire band permitted by international standards. Thus, for earth-satellite transmissions in the C band for example, the permitted band is 500 MHz (from 5925 to 6425 MHz) whereas, at present, the momentary pass band of klystrons is only from 40 to 45 MHz.

In a device for selecting the resonance frequency of microwave cavities of the prior art, the frequency band to be covered is divided into several channels of central frequency $F_1$, $F_2$, $F_3$, . . . for which the selection device is preset. This selection device, which will be described in more detail hereinafter, comprises n cavities which are aligned and of which one of the walls is formed by a plunger. These plungers are integral with shafts which are forced by springs against n aligned stops. These n stops are carried by n discs which are mutually rotated and each of which carries several stops, n stops always being substantially aligned and ready to receive the shafts of the plungers; the degree of penetration of the stops within the discs being pre-adjusted in dependence upon the central frequency of the various channels.

This device of the prior art has major advantages: it enables the degree of penetration of the stops for the various channels to be adjusted with extreme precision, these adjustments being maintained under adverse temperature and environmental conditions to which the klystrons may be exposed; the change of channel takes place very quickly and very simply; its service life is very long, being as long as or longer than that of the klystron, and there is only minimal wear, with the result that its level of performance is highly reproducible.

The disadvantage of this device of the prior art is that it is difficult and even impossible to produce for very high frequencies, for example in the Ku band. For frequencies lower than those of the Ku band, the number of stops and, hence, channels is already limited because, when the frequency increases, the dimensions of the cavities decrease as, hence, do the dimensions of the discs supporting the stops. In the Ku band for example, when five cavities are used, the distance between the end cavities is less than 30 mm. In this case, it becomes very difficult to produce and use a disc-type device such as this on account of the tolerances imposed on the various elements, the precision of the assembly and the smallness of certain gears.

The present invention relates to a device for selecting the resonance frequency of microwave cavities which has the above-mentioned advantages of the device of the prior art and which, in addition, may be used at very high frequencies, for example on the Ku band. Abother advantage of this device is that it may be readily comprise a very large number of channels.

The device according to the invention for selecting the resonance frequency of a microwave device comprises n cavities which are aligned and each provided with means enabling the volume and hence the resonance frequency of each cavity to be varied, then n volume varying means bearing against n stops which are aligned on one and the same support, the degree of penetration of each stop within the support being adjustable, said support carrying a plurality of lines of n stops against which the means enabling the volume to be varied may be successively applied. The means enabling the volume of the cavities to be varied comprises a plunger forming one of the walls of the cavity, said plunger being integral with a shaft which bears against the stop.

Figure 1B:
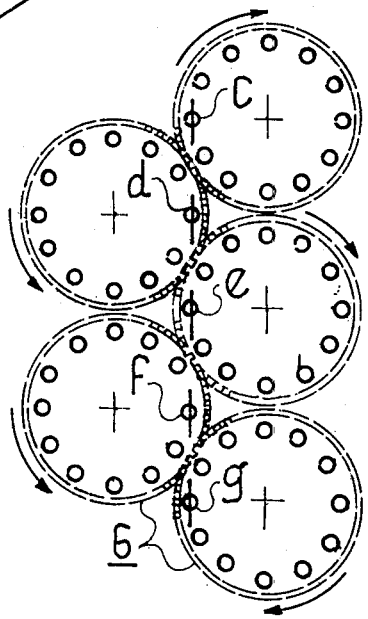
PRIOR ART FIG 1b

Other objects, features and results of the invention will become apparent from the following description given by way of non-limiting example and illustrated by the accompanying drawings, wherein:

FIGS. 1*a* and 1*b* are, respectively, a perspective view of a device of the prior art for selecting the resonance frequency of microwave cavities and a front view of the discs carrying the stops.

Figure 2A:
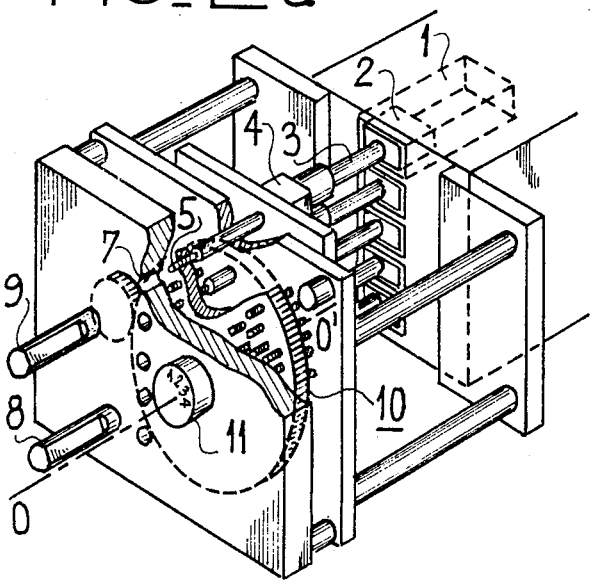
Figure 2B:
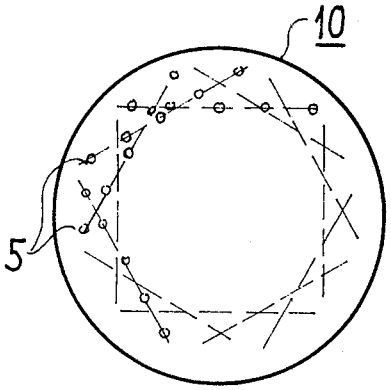

FIGS. 2*a* and 2*b* are, respectively, a perspective view of one embodiment of the device according to the invention for selecting the resonance frequency of microwave cavities and a front view of the disc carrying the stops.

Figure 3:
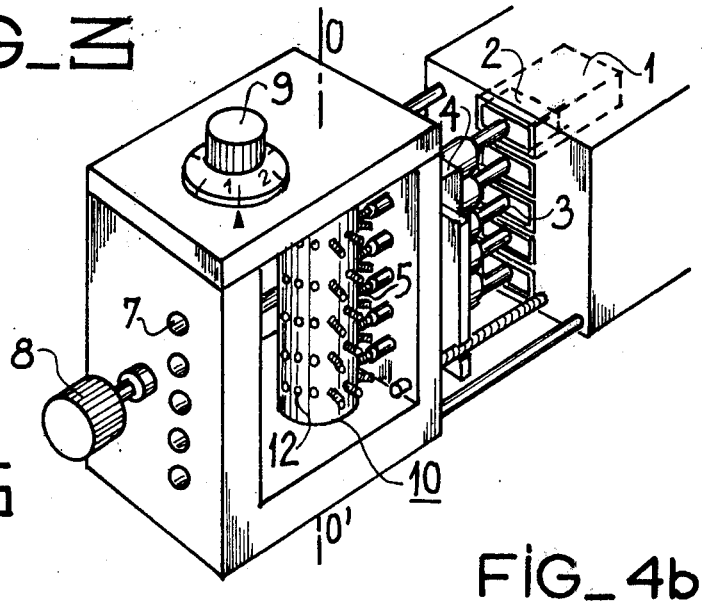

FIG. 3 is a perspective view of another embodiment of the device according to the invention.

Figure 4A:
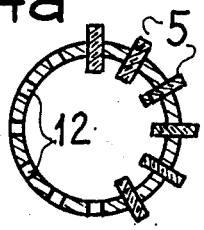
Figure 4B:
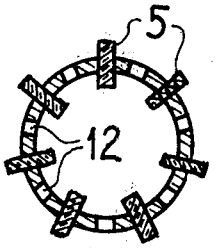

FIGS. 4*a* and 4*b* show two arrangements of the stops and the orifices for the final adjustmant of the stops on the cylinder shown in FIG. 3.

Figure 5:
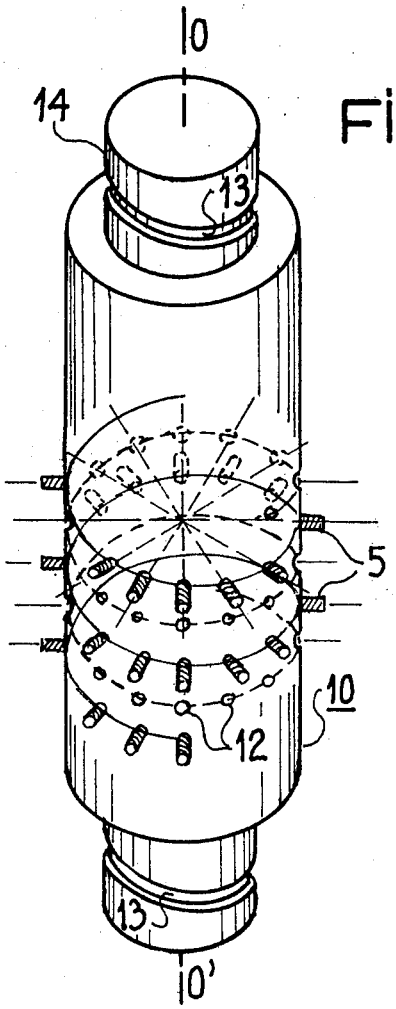
Figure 6:
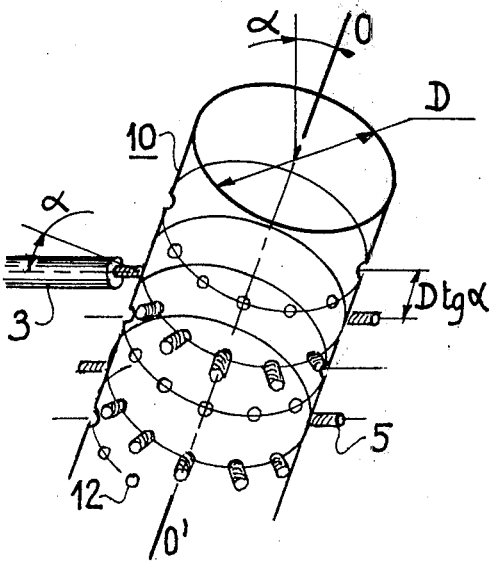

FIGS. 5 and 6 show another two embodiments of the support carrying the stops of the device according to the invention.

In these various Figures, the same reference denote the same elements and, in the interests of clarity, the dimensions and proportions of the various elements are not to scale.

FIG. 1*a* is a perspective view of a device of the prior art for selecting the resonance frequency of microwave cavities.

The illustrated device comprises 5 aligned cavities 1 in each of which one of the walls is formed by a plunger 2. The plungers 2 are integral with shafts 3 which are forced by springs accommodated in the block 4 against stop screws 5 carried by five discs 6. These discs 6 are shown in front elevation in FIG. 1*b*. They are mutually rotated in the direction of the arrows indicated in the Figure. A number of stops corresponding to the maximum number of channels is provided on each disc. The discs are disposed in such a way that five stops are always substantially aligned. In the Figure, the stops c, d, e, f, g, are aligned. The stops are pre-adjusted before the discs are assembled. They are adjusted with extreme precision with respect to the final installation by means of five orifices 7 disposed in the front face of the device. The stops 5 may be formed by screws for example. In order to change channel, the block 4 and, hence, the plungers 2 are depressed into the cavities 1 by means of a first button 8. The shafts 3 of the plungers are then no longer applied to the stops 5, i.e. the shafts are unlocked. By means of a second button 9, one of the discs 6 is turned and entrains the following discs to change alignment. The button 8 is then operated in the opposite direction to force the shafts 3 against the stops 5, i.e. the shafts are locked.

FIG. 2*a* is a perspective view of one embodiment of the device according to the invention for selecting the resonance frequency of microwave cavities.

This device differs from the device illustrated in FIG. 1 in the fact that the stops 5, against which the shafts 3 of the plungers are forced for a given channel are aligned on the same support 10. This support 10 carries several lines of stops against which the shafts 3 of the plungers may be successively applied.

In FIG. 2*a*, the support 10 is a disc of which the axis of rotation 00' is parallel to the shafts of the plungers.

FIG. 2*b* shows one example of alignment of the stops 5 on the disc 10. In this Figure, twelve channels are provided in the case where five cavities are used.

The change of channel is obtained by rotating the disc in the same way as in the known device. The channel may be automatically indicated by a graduated button 11 integral with the shaft 00' of the disc 10.

With the device according to the invention, there is no longer any problem of overcrowding, even at very high frequencies, because the disc may be selected as large as required.

FIG. 3 is a perspective view of another embodiment of the device according to the invention.

In this embodiment, the support 10 is formed by a cylinder of revolution of which the axis of rotation 00' is orthogonal to the shafts 3 of the plungers. The lines of stops 5 are disposed on the generatrices of the surface of the cylinder. The change of channel is obtained by rotating the cylinder in the same way as in the known device. The stops against which the same shafts 3 for the various channels are forced are disposed on circles orthogonal to the axis of rotation 00' of the cylinder. The diameter of the cylinder may be selected as large as required for increasing the number of channels.

Diametrically opposite each stop 5, the cylinder is formed with an orifice 12 enabling the degree of penetration of the stop within the cylinder to be adjusted with extreme precision.

FIGS. 4*a* and 4*b* show two arrangements of the stops and the orifices for the final adjustment of the stops on the cylinder shown in FIG. 3. These figures are cross sections through the cylinder 10.

In FIG. 4*a*, one half of the cylinder is occupied by the stops 5 whilst the other half is occupied by the orifices 12 for the final adjustment of the corresponding stops.

In FIG. 4*b*, stops 5 and orifices 12 alternate with one another on circles othogonal to the axis of rotation (00') of the cylinder.

The advantage of the arrangement shown in FIG. 4*b* is that, during the change of channel, it provides for a greater angle of rotation than the arrangement shown in FIG. 4*a*. Thus, with the arrangement shown in FIG. 4*b*, the rotating control elements do not have be very small and, hence, very delicate so that better angular definition may be obtained.

FIG. 5 shows another embodiment of the support carrying the stops of the device according to the invention.

The support shown in FIG. 5, like that shown in FIG. 3, is a cylinder of revolution the axis of which of rotation 00' is orthogonal to the shafts 3 of the plungers and the lines of stops 5 are also disposed on the surface of the cylinder. The difference between the support shown in FIG. 5 and the support shown in FIG. 3 lies in the fact that the stops 5 are disposed on a spiral of which the axis is formed by the axis of rotation of the cylinder 00'. The change of channel is obtained by rotating the cylinder in the same way as in the known device, except that this rotation is accompanied by a translatory movement of the cylinder along its axis of rotation due to helical guiding by one or more ramps 13 provided for this purpose on the shaft of the cylinder 14.

The orifices 12 for the final adjustment of the stops 5 are disposed on a spiral identical with that on which the stops are disposed, but offset by 180°, one orifice 12 being diametrically opposite each stop 5.

FIG. 5 shows in chain lines the two spirals and some lines joining the stops to their corresponding final adjustment orifices.

The advantage of this embodiment over the embodiment illustrated in FIG. 3 is that is enables the 360° of the cylinder to be used for positioning the stops. In the embodiment shown in FIG. 3, the stops are only disposed over 180° to enable the orifices for the final adjustment of the stops to be positioned over the remaining 180°.

Another embodiment of the support carrying the stops of the device according to the invention is shown in FIG. 6. Like the previously described embodiment, it enables the 360° of the cylinder to be used for positioning the stops.

The support 10 is a cylinder of revolution of which the axis of rotation 00' is inclined at an angle $\alpha$ in relation to the axis along which the cavities 1 are aligned and contained in a plane intersecting this axis. The lines of stops 5 are disposed on the generatrices of the surface of the support, the passage from one line to the following line being obtained by rotation of the support. The stops to which the same shafts 3 of the plungers 2 are successively applied are disposed on circles othogonal to the axis of rotation 00'. The orifices 12 for the final adjustment of the stops are also disposed on circles orthogonal to the axis of rotation of the support. Each of these circles is associated with a circle carrying the stops from which it is separated by a distance D. tangent $\alpha$, D being the diameter of the cylinder 10, in such a way that the stops 5 which are inclined at an angle $\alpha$ relative to the support and the orifices for the final adjustment of the stops 12 are situated in the extention of the shafts 3 of the plungers 2.

The support 10 may also be a frustum with a half-angle $\alpha$ at its apex arranged in such a way that the shafts 3 are orthogonal to the wall of the support carrying the stops to which they are applied, the orifices for the final adjustment of the stops and the stops being disposed on circles alternating in such a way that the stops and the orifices are situated in the extention of the shafts of the plungers.

Since the stops and the orifices for the final adjustment of the stops are disposed on circles, the two previously described embodiments are easier to produce than the embodiment illustrated in FIG. 5, where the stops and the orifices are disposed on ellipses whilst also having the advantage of enabling the 360° of the support to be used for positioning the stops.

In addition to klystrons and frequency filters, the device according to the invention may be used for any applications requiring multiple selections of the resonance frequency of microwave cavities.

What is claimed is:

1. Apparatus for selecting the resonance frequency of a microwave device comprising n aligned microwave cavities, each including means for varying the volume and hence the resonance frequency of the cavity, said n volume varying means bearing against n stops, said n stops being aligned on one and the same support, the degree of penetration of each stop within the support being adjustable, said support carrying a plurality of lines of n stops against which the volume varying means may be successively applied.

2. Apparatus as claimed in claim 1, wherein said volume varying means comprises a plunger, forming one of the walls of the cavity, said plunger being integral with a shaft which bears against said stop.

3. Apparatus as claimed in claim 2, wherein said support comprises a disc the axis of rotation of which is parallel to the shafts of the plungers, the passage from one line of n stops to the following line being obtained by rotation of the disc.

4. Apparatus as claimed in claim 2, wherein said support comprises a cylinder of revolution the axis of rotation of which is orthogonal to the shafts of the plungers.

5. Apparatus as claimed in claim 4, wherein the lines of n stops are disposed on the surface of said cylinder, the passage from one line of n stops to the following line being obtained by rotation of the cylinder, the stops to which the same shafts of the plungers are successively applied being disposed on circles orthogonal to the axis of rotation of the cylinder and wherein the orifices for the final adjustment of the stops on the cylinder are disposed on circles orthogonal to the axis of rotation of the cylinder and carrying the stops, each orifice being diametrically opposite a stop.

6. Apparatus as claimed in claim 5, wherein the stops and the orifices for the final adjustment of the stops alternate on circles orthogonal to the axis of rotation of the cylinder.

7. Apparatus as claimed in claim 4, wherein the lines of n stops are disposed on the surface of the cylinder, the passage from one line of n stops to the following line being obtained by rotation of the cylinder and by translation along its axis of rotation, the stops being disposed on a spiral of which the axis is formed by the axis of rotation of the cylinder and wherein the orifices for the final adjustment of the stops are disposed on a spiral offset by 180° in relation to the spiral carrying the stops, one orifice being diametrically opposite each stop.

8. Apparatus as claimed in claim 2, wherein the support has an axis of rotation inclined at an angle $\alpha$ in relation to the axis along which the cavities are aligned, this axis of rotation being contained in a plane intersecting the axis along which the cavities are aligned, the lines of n stops being disposed on the surface of the support, the passage from one line of n stops to the following line being obtained by rotation of the support and the stops to which the same shafts of the plungers are successively applied being disposed on circles orthogonal to the axis of rotation of the support, the orifices for the final adjustment of the stops also being disposed on circles orthogonal to the axis of rotation of the support, each of these circles being associated with a circle carrying the stops from which it is separated by such a distance that the stops and the orifices for the final adjustment of the stops are in the extension of the shafts of the plungers.

9. Apparatus as claimed in claim 8, wherein said support comprises a cylinder of revolution of diameter D, the distance separating a circle carrying the stops from the circle on which the orifices for the final adjustment of the corresponding stops are disposed being equal to D. tangent $\alpha$, the stops being inclined at an angle $\alpha$ relative to the cylinder.

10. Apparatus as claimed in claim 8, wherein said support comprises a frustum with a half-angle $\alpha$ at its apex disposed in such a way that the shafts of the plungers are orthogonal to the wall of the support carrying the stops to which they are applied.

* * * * *